US008326189B2

(12) United States Patent
Fukuda et al.

(10) Patent No.: US 8,326,189 B2
(45) Date of Patent: Dec. 4, 2012

(54) DEVELOPING DEVICE, PROCESS CARTRIDGE, AND IMAGE FORMING APPARATUS

(75) Inventors: Yoshiyuki Fukuda, Tokyo (JP); Katsumi Masuda, Kanagawa (JP); Nobuyuki Taguchi, Kanagawa (JP); Yuuki Satoh, Kanagawa (JP); Yasufumi Takahashi, Tokyo (JP); Keiichi Yoshida, Kanagawa (JP); Yoshio Hattori, Kanagawa (JP); Akira Azami, Kanagawa (JP); Takamasa Ozeki, Kanagawa (JP); Toshiki Hayashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 193 days.

(21) Appl. No.: 12/860,203

(22) Filed: Aug. 20, 2010

(65) Prior Publication Data

US 2011/0058858 A1 Mar. 10, 2011

(30) Foreign Application Priority Data

Sep. 8, 2009 (JP) ..... 2009-206536
Oct. 7, 2009 (JP) ..... 2009-232964

(51) Int. Cl.
*G03G 15/06* (2006.01)
*G03G 15/09* (2006.01)

(52) U.S. Cl. ..... 399/272; 399/254; 399/267; 399/273

(58) Field of Classification Search ..... 399/272, 399/273, 254, 256, 267, 277
See application file for complete search history.

(56) References Cited

U.S. PATENT DOCUMENTS

| | | | | |
|---|---|---|---|---|
| 7,917,066 | B2 * | 3/2011 | Ootsuka | 399/254 |
| 2008/0085137 | A1 * | 4/2008 | Suzuki | 399/254 |
| 2008/0085138 | A1 * | 4/2008 | Yoshida | 399/256 |
| 2009/0245882 | A1 | 10/2009 | Ozeki et al. | 399/260 |
| 2009/0245887 | A1 | 10/2009 | Masuda et al. | 399/276 |
| 2009/0245889 | A1 | 10/2009 | Koetsuka et al. | 399/277 |

FOREIGN PATENT DOCUMENTS

| | | |
|---|---|---|
| JP | 11-174810 | 7/1999 |
| JP | 3950735 B2 | 4/2007 |
| JP | 2008-26408 | 2/2008 |

OTHER PUBLICATIONS

Machine translation of JP 2008-026408 dated Apr. 23, 2012.*

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

There is provided a separation member for separating a first conveying path formed by a first conveying member from a second conveying path formed by a second conveying member. There is also provided an opposed member facing a magnetic pole H4 at an upstream side of two magnetic poles H4 and H6 that forms a developer-releasing magnetic pole H5.

17 Claims, 6 Drawing Sheets

DEVELOPING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese Patent Application No. 2009-206536 filed in Japan on Sep. 8, 2009 and Japanese Patent Application No. 2009-232964 filed in Japan on Oct. 7, 2009.

BACKGROUND OF THE INVENTION

1. Field of the Invention

The present invention relates to an image forming apparatus such as a copier, a printer, and a facsimile, or a multifunction product of these devices using an electrophotographic system, and to a developing device and a process cartridge provided therein. More particularly, the present invention relates to a developing device in which at least two conveying members among a plurality of conveying members that forms a circulation route through which a developer is conveyed along the longitudinal direction are arranged so as to face a developer carrier and in which a developer regulating member for regulating an amount of developer at an upstream side of a developing region is disposed below the developer carrier, and to a process cartridge and an image forming apparatus.

2. Description of the Related Art

Conventionally, there has been known a technology for a developing device, which stores a two-component developer containing toner and carrier (which also includes a case of adding external additives or the like) in an image forming apparatus such as a copier and a printer, and in which at least two conveying members among a plurality of conveying members for forming a circulation route through which a developer is conveyed along the longitudinal direction are vertically arranged and in which a developer regulating member for regulating an amount of developer at an upstream side of a developing region is disposed below a developer carrier (e.g., see Japanese Patent Application Laid-open No. H11-174810, Japanese Patent Application Laid-open No. 2008-26408 and Japanese Patent No. 3950735).

The developing device using the two-component developer has a toner supply port provided at a part of the developing device, and toner is appropriately supplied into the developing device through the toner supply port depending on toner consumption in the developing device. The supplied toner is stirred and mixed with the developer in the developing device by a conveying member (a stirring and conveying member) such as a conveying screw. Part of the stirred and mixed developer is supplied to a developing roller (developer carrier). The developer carried on the developing roller is controlled to an appropriate amount by a doctor blade (developer regulating member) disposed below the developing roller, and then, the toner in the two-component developer is caused to adhere to a latent image formed on a photosensitive drum at an opposite position to the photosensitive drum (image carrier). A magnet is fixed inside the developing roller, and a plurality of magnetic poles is formed around the developing roller by the magnet.

A first conveying member (a supplying screw) and a second conveying member (a collecting screw) are arranged vertically in the developing device disclosed in Japanese Patent Application Laid-open No. H11-174810 and the like.

These two conveying members form a circulation route of the developer. The first conveying member arranged in the lower side of the developing device supplies the developer to the developing roller at a position of a developer-scoop-up magnetic pole while conveying the developer along the longitudinal direction. The second conveying member arranged in the upper side of the developing device conveys the developer released from the developing roller at a position of a developer-releasing magnetic pole along the longitudinal direction (a direction opposite to the conveying direction of the first conveying member). The downstream side of a conveying path formed by the first conveying member (a first conveying path) communicates with the upstream side of a conveying path formed by the second conveying member (a second conveying path) through a first relay portion. The developer having reached the downstream side in the first conveying path stays at the position and is pushed up to reach the upstream side in the second conveying path. Here, the toner supply port is provided at an upstream side in the second conveying path and new toner is appropriately supplied through the toner supply port. The upstream side in the first conveying path communicates with the downstream side in the second conveying path through a second relay portion. The developer having reached the downstream side in the second conveying path drops in the second relay portion by its own weight, and is moved to the upstream side in the first conveying path.

The developing device in which the conveying members are vertically arranged in the above manner can be made small in the horizontal direction as compared with a developing device in which a plurality of conveying members is horizontally arranged (see, for example, FIG. 19 in Japanese Patent Application Laid-open No. 2008-26408). Therefore, the compact developing device is often used in tandem type color image forming apparatuses in which a plurality of developing devices is horizontally arranged. A developing device, in which the conveying members are vertically arranged and a supplying route (the first conveying path) of a developer to the developer carrier is separated from a collecting route (the second conveying path) of a developer released from the developer carrier, can reduce a concentration deviation in a toner image formed on the image carrier because the developer after a developing process is hard to be contained in a developer to be carried on the developing roller and be supplied to the developing process, as compared with the developing device in which the conveying members are horizontally arranged (see, for example, FIG. 19 in Japanese Patent Application Laid-open No. 2008-26408).

As explained above, an image forming apparatus that includes a developing device with the doctor blade (developer regulating member) disposed below the developing roller can reduce the length of a paper conveying path from a paper feeding unit (paper storage) disposed in the lower part of the image forming apparatus to a paper ejection tray, as compared with an image forming apparatus that includes a developing device (see, for example, FIG. 19 in Japanese Patent Application Laid-open No. 2008-26408) with the doctor blade disposed above the developing roller. Thus, first print time in the tandem type color image forming apparatuses can be reduced (see, for example, FIG. 1 in Japanese Patent Application Laid-open No. 2008-26408). Furthermore, because a layout that the paper ejection tray is disposed in an upper side of the image forming apparatus can be easily provided even if the paper conveying path is made comparatively shorter, this layout is often used in the tandem type color image forming apparatuses which are made small in the horizontal direction.

In the developing devices disclosed in Japanese Patent Application Laid-open No. H11-174810, Japanese Patent Application Laid-open No. 2008-26408 and Japanese Patent No. 3950735, the developer released from the developing roller after the developing process at the position of the developer-releasing magnetic pole may be again carried on the developing roller in the second conveying path. Such an inconvenience becomes a non-negligible problem especially in the developing device in which the second conveying path (collecting route) is disposed above the first conveying path (supplying route). Moreover, the inconvenience becomes more significant when the fluidity of the developer decreases caused by degradation of the developer over time.

Once the inconvenience occurs, the developer after the developing process (developer in which the toner is consumed) is contained in a developer which is to be carried on the developing roller and be supplied to the developing process, and this causes concentration deviation to occur in a toner image formed on the image carrier.

In order to suppress the inconvenience, there are possible measures that provide a separation member for separating the first conveying path from the second conveying path so as to face the developer carrier and that optimize the position of the developer-releasing magnetic pole and the position of the second conveying path. Furthermore, in order to reliably release the developer from the developing roller at the position of the developer-releasing magnetic pole, there are also possible measures that set magnetic force of two magnetic poles having the same polarity and forming the developer-releasing magnetic pole to be sufficiently large.

In these cases, however, there is a possibility to cause such an inconvenience that the developer released from the developing roller at the position of the developer-releasing magnetic pole is again carried (re-carried) on the developing roller by the magnetic force of an upstream-side magnetic pole of the two magnetic poles that form the developer-releasing magnetic pole. Once the inconvenience occurs, the load of the developing roller at the position where the developer is re-carried thereon becomes heavy, which causes rotational torque of the developing roller to increase.

SUMMARY OF THE INVENTION

It is an object of the present invention to at least partially solve the problems in the conventional technology.

According to an aspect of the present invention a developing device stores therein a developer containing carrier and toner and develops a latent image formed on an image carrier, the developing device comprises: a developer carrier that is disposed opposite to the image carrier and forms a plurality of magnetic poles around the developer carrier; a developer regulating member that is disposed below the developer carrier so as to oppose thereto and regulates an amount of the developer carried on the developer carrier; and a plurality of conveying members that forms a circulation route through which the developer stored in the developing device is conveyed along a longitudinal direction, wherein the plurality of conveying members includes a first conveying member that is opposite to the developer carrier and supplies the developer to the developer carrier while conveying the developer along the longitudinal direction, and a second conveying member that is disposed above the first conveying member so as to face the developer carrier, and conveys the developer released from the developer carrier along the longitudinal direction, the developing device further comprises a separation member that is disposed in a position opposite to the developer carrier, and separates a first conveying path formed by the first conveying member from a second conveying path formed by the second conveying member, wherein the developer carrier is formed in such a manner that a developer-releasing magnetic pole for releasing the developer carried on the developer carrier, among the plurality of magnetic poles, is sandwiched by two magnetic poles having the same polarity, and an opposed member facing the magnetic pole, of the two magnetic poles, formed at an upstream side of the developer carrier in its rotation direction is disposed at the upstream side of the developer carrier in the rotation direction while the separation member is located opposite to the developer carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments to implement the present invention will be explained in detail below.

First Embodiment

Embodiments to implement the present invention will be explained in detail below with reference to the accompanying drawings. It should be noted that same numerals are assigned to those the same as or corresponding to portions in the figures, and thus explanation thereof is appropriately simplified or omitted.

First, configuration and operation of an overall image forming apparatus will be explained below with reference to FIG. 1.

Figure 1:
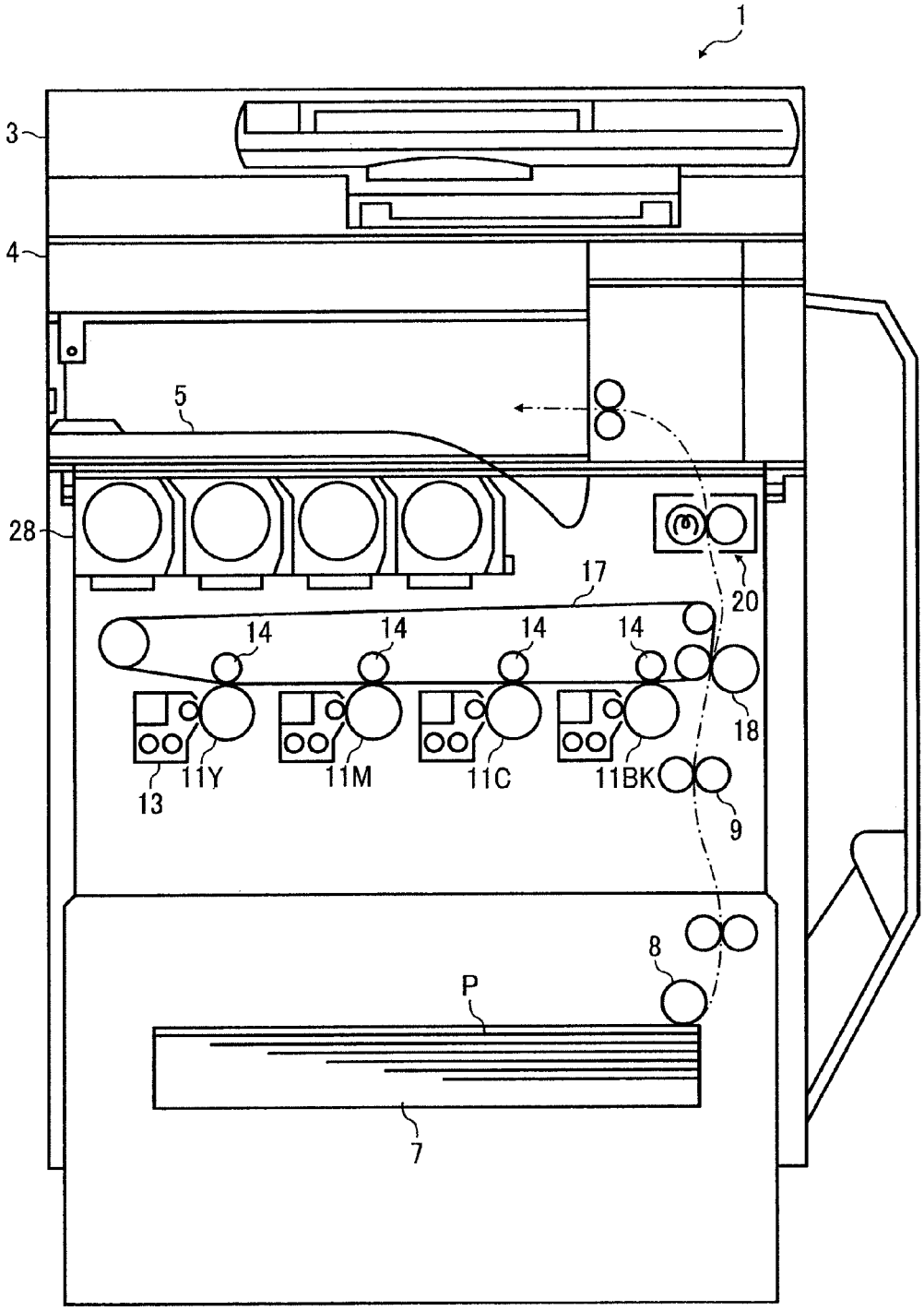
FIG. 1 is an explanatory diagram of an overall configuration representing an image forming apparatus according to an embodiment of the present invention.

In FIG. 1, 1 represents an apparatus body of a tandem type color copier as the image forming apparatus; 3: an original feeding unit for feeding an original to an original reading unit; 4: the original reading unit for reading image information of the original; 5: a paper ejection tray where an output image is stacked; 7: a paper feeding unit where a recording medium P such as a transfer paper is stored; 9: a registration roller for controlling a timing of conveying the recording medium P; 11Y, 11M, 11C, and 11BK: photosensitive drums as image carriers where toner images of colors (yellow, magenta, cyan, and black) are formed respectively; 13: developing devices for developing an electrostatic latent image formed on each of the photosensitive drums 11Y, 11M, 11C, and 11BK; and 14: transfer bias rollers (primary-transfer bias rollers) for transferring the toner images formed on the photosensitive drums 11Y, 11M, 11C, and 11BK to the recording medium P in a superimposing manner.

Moreover, 17 represents an intermediate transfer belt to which the toner images of the colors are superposedly transferred; 18: a secondary-transfer bias roller for transferring a color toner image on the intermediate transfer belt to the recording medium P; 20: a fixing unit for fixing an unfixed image on the recording medium P; and 28: toner containers of the colors for supplying toners (toner particles) of the colors (yellow, magenta, cyan, and black) to the developing devices 13, respectively.

The operation of forming an ordinary color image in the image forming apparatus will be explained below. It should be noted that imaging processes performed on the photosensitive drums 11Y, 11M, 11C, and 11BK may be also referred to FIG. 2.

First, an original is fed from an original tray by a feeding roller of the original feeding unit 3 and is set on a contact glass of the original reading unit 4. Then, the original reading unit 4 optically reads image information for the original set on the contact glass.

More specifically, the original reading unit 4 scans an image of the original on the contact glass while irradiating the image with light emitted from an illumination lamp. The light reflected by the original is then formed on a color sensor through a mirror group and a lens. Color image information of the original is read by the color sensor with each of color-separated lights of RGB (red, green, and blue), and is electrically converted into image signals. The color image information is further subjected to processes such as a color conversion process, a color correction process, and a spatial-frequency correction process in an image processing unit based on the color-separated image signals of RGB, to obtain the color image information for yellow, magenta, cyan, and black.

The image information for the colors of yellow, magenta, cyan, and black is transmitted to a writing unit (not shown). Laser lights L (see FIG. 2) are emitted from the writing unit to the corresponding photosensitive drums 11Y, 11M, 11C, and 11BK based on the image information for the colors, respectively.

Meanwhile, the four photosensitive drums 11Y, 11M, 11C, and 11BK are made to rotate in the clockwise direction of FIG. 1. Each of the surfaces of the photosensitive drums 11Y, 11M, 11C, and 11BK is uniformly charged at an opposed portion to a charging unit 12 (see FIG. 2) (which indicates a charging process). A charging potential is thereby formed on each of the photosensitive drums 11Y, 11M, 11C, and 11BK. Thereafter, each of the charged surfaces of the photosensitive drums 11Y, 11M, 11C, and 11BK reaches an irradiation position of corresponding laser light.

The writing unit emits laser lights corresponding to image signals from four light sources, respectively, according to the colors. The laser lights pass through different light paths for color components of the yellow, magenta, cyan, and black, respectively (which indicates an exposing process).

The laser light corresponding to the yellow component is irradiated to the surface of the photosensitive drum 11Y at the first place from the left side on the plane of paper. At this time, the laser light of the yellow component is scanned in a rotation axis direction (main scanning direction) of the photosensitive drum 11Y by a polygon mirror rotating at a high speed. In this manner, an electrostatic latent image corresponding to the yellow component is formed on the photosensitive drum 11Y after being charged by the charging unit 12.

Likewise, the laser light corresponding to the magenta component is irradiated to the surface of the photosensitive drum 11M at the second place from the left side on the plane of paper, and an electrostatic latent image corresponding to the magenta component is formed thereon. The laser light corresponding to the cyan component is irradiated to the surface of the photosensitive drum 11C at the third place from the left side on the plane of paper, and an electrostatic latent image corresponding to the cyan component is formed thereon. The laser light corresponding to the black component is irradiated to the surface of the photosensitive drum 11BK at the fourth place from the left side on the plane of paper, and an electrostatic latent image corresponding to the black component is formed thereon.

Thereafter, the surfaces of the photosensitive drums 11Y, 11M, 11C, and 11BK where the electrostatic latent images of the colors are formed reach opposed positions to the developing device 13, respectively. Then, the toners of the colors are supplied from the developing devices 13 to the photosensitive drums 11Y, 11M, 11C, and 11BK, respectively, and the latent images on the photosensitive drums 11Y, 11M, 11C, and 11BK are developed (which indicates a developing process).

Thereafter, the surfaces of the photosensitive drums 11Y, 11M, 11C, and 11BK after the developing processes reach opposed portions to the intermediate transfer belt 17, respectively. Here, the transfer bias rollers 14 are disposed at the opposed portions so as to contact an inner peripheral surface of the intermediate transfer belt 17. The toner images of the colors formed on the photosensitive drums 11Y, 11M, 11C, and 11BK are sequentially and superposedly transferred to the intermediate transfer belt 17 at respective positions of the transfer bias rollers 14 (which indicates a primary transfer process).

Each of the surfaces of the photosensitive drums 11Y, 11M, 11C, and 11BK after the transfer processes reaches an opposed position to a cleaning unit 15. The cleaning unit 15 collects non-transferred toner remaining on each of the photosensitive drums 11Y, 11M, 11C, and 11BK (which indicates a cleaning process).

Thereafter, each of the surfaces of the photosensitive drums 11Y, 11M, 11C, and 11BK passes through a decharging unit (not shown), so that a series of imaging processes for the photosensitive drums 11Y, 11M, 11C, and 11BK is finished.

On the other hand, the intermediate transfer belt 17 to which the color toners on the photosensitive drums 11Y, 11M, 11C, and 11BK are superposedly transferred (carried) moves in a counterclockwise direction in the figure and reaches an opposed position to a secondary-transfer bias roller 18. The color toner images carried on the intermediate transfer belt 17 are then transferred to the recording medium P at the opposed position to the secondary-transfer bias roller 18 (which indicates a secondary transfer process).

Thereafter, the surface of the intermediate transfer belt 17 reaches a position of an intermediate-transfer-belt cleaning unit (not shown). The non-transferred toner depositing on the intermediate transfer belt 17 is collected by the intermediate-transfer-belt cleaning unit, so that a series of transfer processes for the intermediate transfer belt 17 is finished.

Here, the recording medium P conveyed to a space (which indicates a secondary transfer nip) between the intermediate transfer belt 17 and the secondary-transfer bias roller 18 is conveyed from the paper feeding unit 7 through the registration roller 9.

More specifically, the recording medium P fed from the paper feeding unit 7 that stores the recording medium P by a paper feeding roller 8 passes through a conveying guide and is guided to the registration roller 9. The recording medium P having reached the registration roller 9 is conveyed toward the secondary transfer nip at an appropriate timing.

The recording medium P with a full-color image transferred thereto is then guided to the fixing device 20. In the fixing device 20, the color image is fixed on the recording medium P at a nip between a fixing roller and a pressing roller.

The recording medium P after being subjected to the fixing process is ejected, as an output image, to the outside of the apparatus body 1 by a paper ejection roller, is stacked on the paper ejection tray 5, and a series of image forming processes is thereby completed.

Next, an imaging unit of the image forming apparatus will be explained in detail below with reference to FIGS. 2 to 7.

Figure 2:
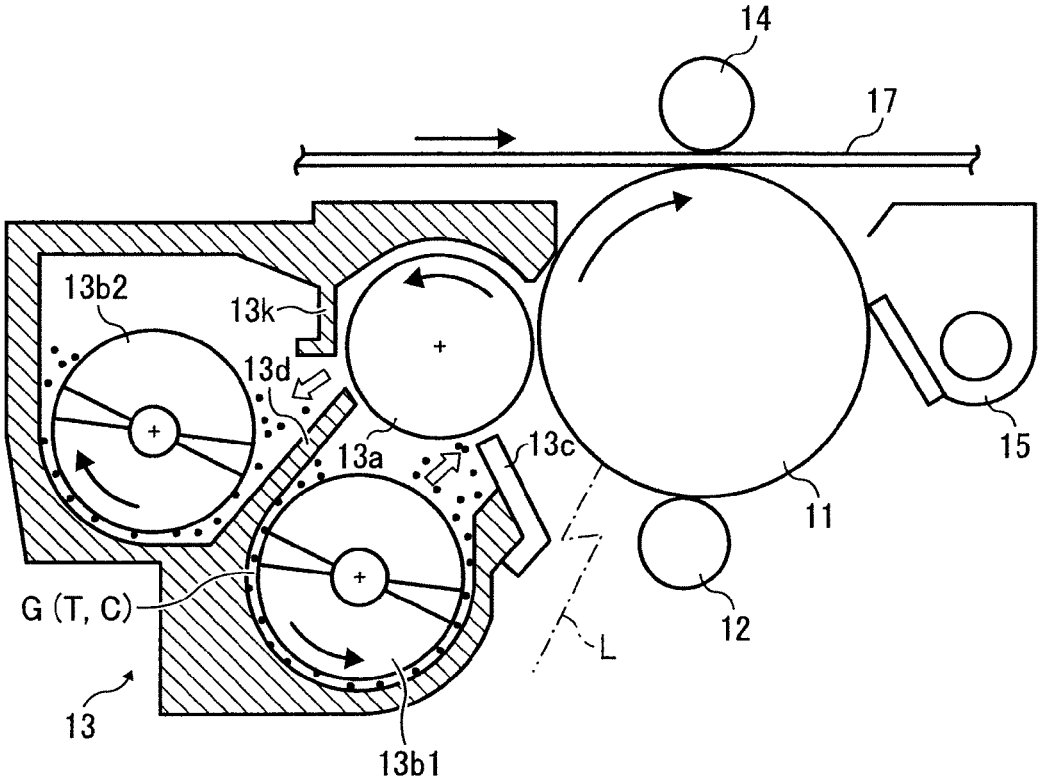
FIG. 2 is an explanatory diagram of a configuration example (1) of an imaging unit shown in FIG. 1.
Figure 3:
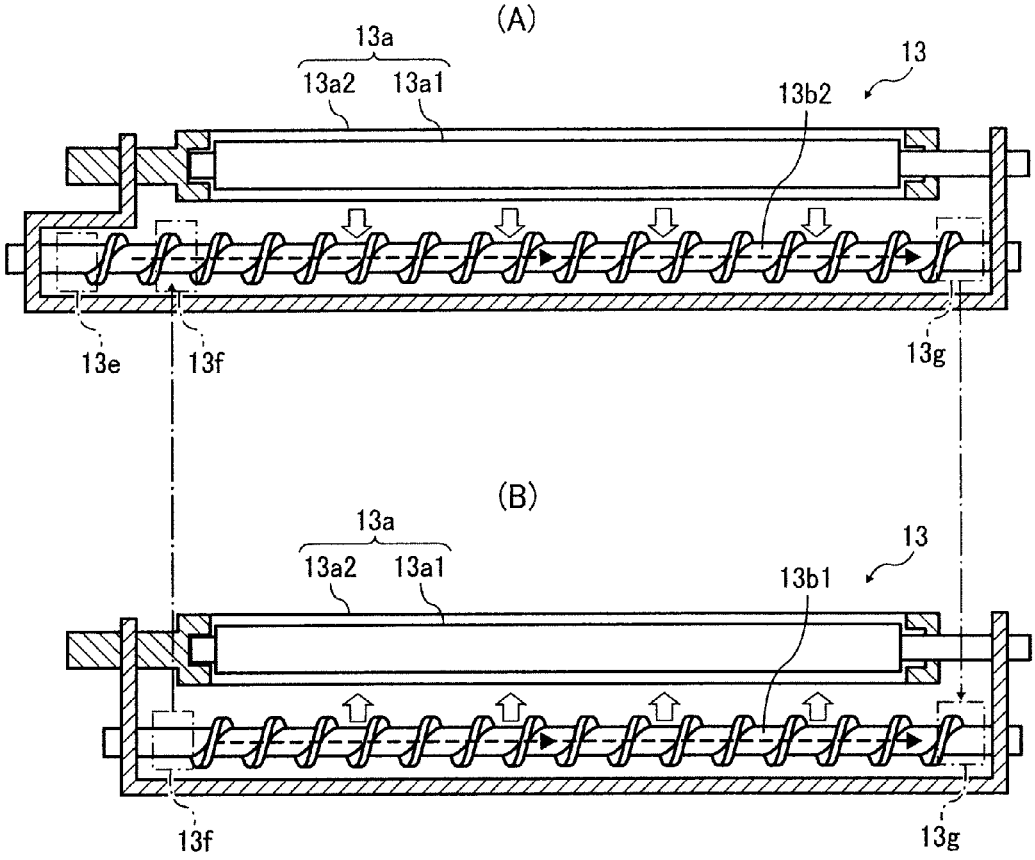
FIG. 3(A) is a cross-sectional view representing a schematic configuration when an upper portion of a developing device is viewed longitudinally.
FIG. 3(B) is a cross-sectional view representing a schematic configuration when a lower portion of the developing device is viewed longitudinally.
Figure 4:
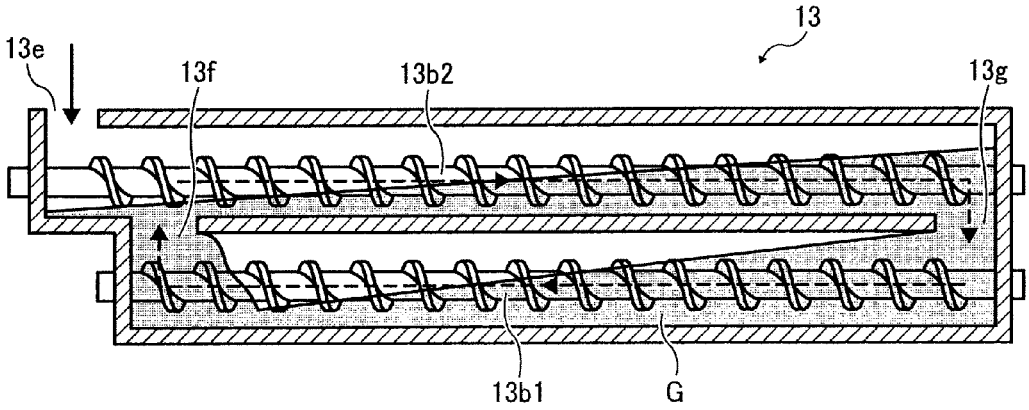
FIG. 4 is a cross-sectional view representing a schematic configuration when a circulation route of the developing device is viewed longitudinally.
Figure 5:
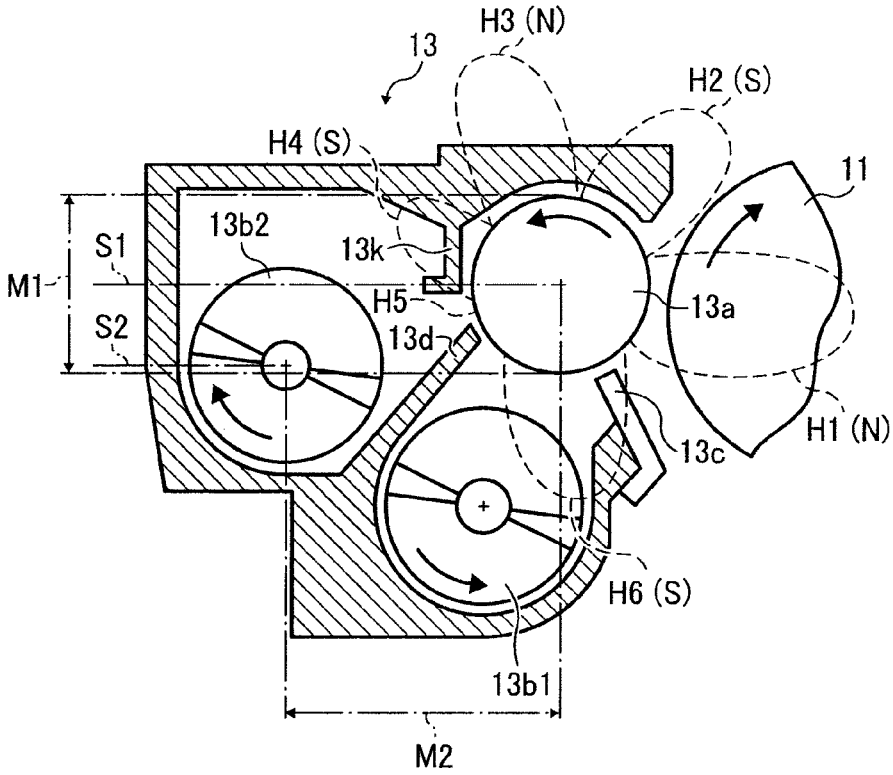
FIG. 5 is an explanatory diagram of a configuration example (1) of the developing device shown in FIG. 2.
Figure 6:
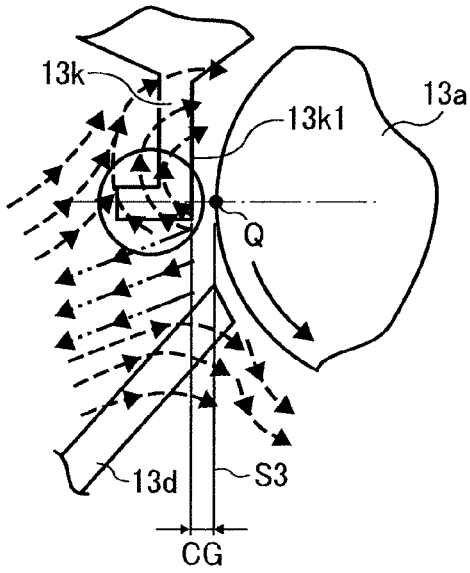
FIG. 6 is a schematic diagram of magnetic fields produced near a separation member and an opposed member of the developing device shown in FIG. 5.
Figure 7A:
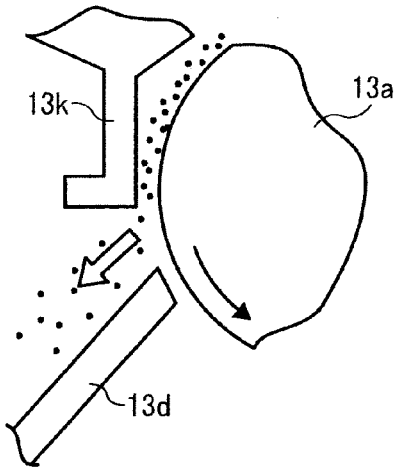
FIG. 7A is a schematic diagram of a flow of a developer near a developer-releasing magnetic pole when the opposed member is disposed in the developing device shown in FIG. 5.
Figure 7B:
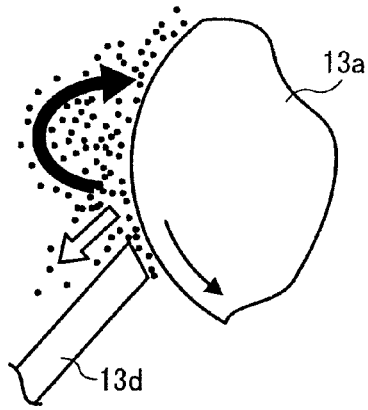
FIG. 7B is a schematic diagram of a flow of the developer near the developer-releasing magnetic pole when the opposed member is not disposed therein.

FIG. 2 is a configuration diagram of the imaging unit. FIG. 3(A) is a schematic cross-sectional view (horizontal cross-sectional view) when an upper portion (where a second conveying screw 13*b*2 as the second conveying member is disposed) of the developing device 13 is viewed longitudinally, and FIG. 3(B) is a schematic cross-sectional view when a lower portion (where a first conveying screw 13*b*1 as the first conveying member is disposed) of the developing device 13 is viewed longitudinally. FIG. 4 is a schematic cross-sectional view (vertical cross-sectional view) when a circulation route of the developing device 13 is viewed longitudinally. FIG. 5 is a cross-sectional view of the developing device (cross-sectional view perpendicular to a rotational central shaft of a developing roller 13*a*), and also represents a magnetic distribution of components in a normal direction of magnetic poles H1 to H6 which are formed on the developing roller 13*a*. FIG. 6 is a schematic diagram of magnetic fields produced near a separation member 13*d* and an opposed member 13*k*. FIG. 7A is a schematic diagram of a flow of a developer near a developer-releasing magnetic pole H5 when the opposed member 13*k* is disposed, and FIG. 7B is a schematic diagram of a flow of the developer near the developer-releasing magnetic pole H5 when the opposed member 13*k* is not disposed.

Because imaging units have almost the same configuration as one another, the imaging units and the developing devices are shown without alphabetical letters (Y, C, M, and BK) in FIGS. 2 to 7.

As shown in FIG. 2, the imaging unit includes the photosensitive drum 11 as an image carrier, the charging unit 12, the developing device 13 (developing unit), and the cleaning unit 15.

The photosensitive drum 11 as the image carrier is a negatively charged organic photosensitive element whose outer diameter is about 30 millimeters and is driven to rotate in the clockwise direction by a rotation drive mechanism (not shown).

The charging unit 12 is an elastic charging roller with a foamed urethane layer formed in a roller shape on its core bar. The foamed urethane layer has medium resistance and is formed of materials including urethane resin, carbon black as a conductive particle, a sulfating agent, a foaming agent, and the like. The material of the medium-resistance layer of the charging unit 12 that may be used includes a rubber material in which a conductive substance such as carbon black and metal oxide is dispersed into urethane, ethylene-propylene-diene polyethylene (EPDM), butadiene acrylonitrile rubber (NBR), silicone rubber, and isoprene rubber to adjust the resistance, and also includes a foamed material of these.

The cleaning unit 15 includes a cleaning blade that is in sliding contact with the photosensitive drum 11, so that the cleaning unit 15 mechanically removes and collects non-transferred toner on the photosensitive drum 11.

In the developing device 13, the developing roller 13*a* as the developer carrier is disposed so as to be close to the photosensitive drum 11, and a developing region (a developing nip portion) where the photosensitive drum 11 and a magnetic brush contact each other is formed at opposed portions of the two. A developer G (two-component developer) consisting of toner T and carrier C is stored in the developing device 13. In the present embodiment, 300 grams of the developer G in which toner concentration is 7% by weight is stored in the developing device 13. The developing device 13 develops an electrostatic latent image formed on the photosensitive drum 11 (to form a toner image). The configuration and the operation of the developing device 13 will be explained in detail later.

Referring to FIG. 1, the toner container 28 stores therein toner T to be supplied into the developing device 13. Specifically, the toner T is appropriately supplied from the toner container 28 toward inside the developing device 13 through a toner supply port 13*e* via a toner conveying tube (not shown) based on the information of the toner concentration (a ratio of the toner in the developer G) detected by a magnetic sensor (not shown) disposed in the developing device 13.

Information for supply of the toner T is not limited to the information of the toner concentration, but the toner T may be supplied based on the information of image density detected from reflectance and the like of the toner image formed on the photosensitive drum, the intermediate transfer belt, or the like. It may also be determined to implement supply of the toner T based on a combination of these different pieces of information.

The developing device 13 in the image forming apparatus will be explained in detail below.

Referring to FIGS. 2 to 6, the developing device 13 includes the developing roller 13*a* as the developer carrier, the conveying screws 13*b*1 and 13*b*2 (auger screws) as the conveying members, a doctor blade 13*c* as the developer regulating member, the separation member 13*d*, the opposed member 13*k*, and the like.

The developing roller 13*a* as the developer carrier is a developing roller whose outer diameter is as small as about 18 millimeters, and it is configured so that a sleeve 13*a*2 is made of a non-magnetic body such as aluminum, brass, stainless steel, or conductive resin, which is formed into a cylindrical shape, and is caused to rotate in the counterclockwise direction by a rotation drive mechanism (not shown) at a speed of about 150 to 600 rpm. Referring to FIGS. 3 and 5, a magnet 13*a*1 forming a plurality of magnetic poles H1 to H6 on the peripheral surface of the sleeve 13*a*2 is fixed inside the sleeve 13*a*2 of the developing roller 13*a*. The developer G carried on the developing roller 13*a* is conveyed along with the rotation of the developing roller 13*a* in the direction of the arrow, and reaches the position of the doctor blade 13*c*. The developer G on the developing roller 13*a* is regulated to an appropriate amount with the doctor blade 13*c* at this position, and then is conveyed to an opposed position (a developing region) to the photosensitive drum 11. The toner is attracted to the latent image formed on the photosensitive drum 11 by an electric field (a developing electric field) produced in the developing region.

FIG. 5 illustrates the plurality of magnetic poles H1 to H6 formed around the developing roller 13*a* (the sleeve 13*a*2) by the magnet 13*a*1. As illustrated in FIG. 5, the plurality of magnetic poles include a first magnetic pole H1 (main magnetic pole) formed at an opposed position to the photosensitive drum 11, a second magnetic pole H2 (conveying magnetic pole) that is formed at a position on the downstream side of the first magnetic pole H1 and in an upper portion of a developing case, a third magnetic pole H3 (conveying magnetic pole) formed at the downstream side of the second magnetic pole H2 and at the upstream side of a fourth magnetic pole H4 (developer releasing pre-magnetic pole), the fourth magnetic pole H4 (developer releasing pre-magnetic pole) formed at the downstream side of the third magnetic pole H3, a fifth magnetic pole H5 (developer-releasing magnetic pole) formed at a position between the fourth magnetic pole H4 and a sixth magnetic pole H6 and near the separation member 13*d*, and the sixth magnetic pole H6 (developer-scoop-up magnetic pole) formed over a region from an opposed position to the first conveying screw 13*b*1 to an opposed position to the doctor blade 13*c*.

First, the sixth magnetic pole H6 (developer-scoop-up magnetic pole) acts on the carrier as a magnetic body, and the developer G stored in the first conveying path is fed onto the developing roller 13*a*. A part of the developer G carried on the developing roller 13*a* is scraped off at the position of the doctor blade 13*c* and is returned to the first conveying path. On the other hand, the developer G, which is carried on the developing roller 13*a* having passed through a doctor gap between the doctor blade 13*c* and the developing roller 13*a* at the position of the doctor blade 13*c* on which the magnetic force by the sixth magnetic pole H6 acts, forms toner chains at the first magnetic pole H1 (main magnetic pole) to become a magnetic brush in the developing region, and is brought into a sliding contact with the photosensitive drum 11. In this manner, the toner T in the developer G carried on the developing roller 13*a* attaches to the latent image on the photosensitive drum 11. Thereafter, the developer G having passed through the position of the first magnetic pole H1 is conveyed to the position of the fifth magnetic pole H5 (developer-releasing magnetic pole) by the second magnetic pole H2, the third magnetic pole H3, and the fourth magnetic pole H4. Then, a repulsive magnetic field (which is a magnetic field acting on a direction away from the developing roller 13*a* in FIG. 6) acts on the carrier at the position of the developer-releasing magnetic pole H5, and the developer G carried on the developing roller 13*a* after the developing process is released from the developing roller 13*a*. The released developer G drops into the second conveying path and is conveyed downstream in the second conveying path by the second conveying screw 13*b*2.

Here, referring to FIG. 5, the six magnetic poles H1 to H6 are formed of five poles (magnetic poles with "(N)" or "(S)" added to the reference numerals in FIG. 5) magnetized by the magnet 13*a*1 of the developing roller 13*a*. More specifically, among the six magnetic poles H1 to H6, only the fifth magnetic pole H5 (developer-releasing magnetic pole) is not directly formed by the pole magnetized by the magnet 13*a*1, but is formed in such a manner that it is sandwiched by two magnetic poles (the fourth magnetic pole H4 and the sixth magnetic pole H6) having the same pole (south (S) pole in the present embodiment).

Referring to FIG. 2 and the like, the doctor blade 13*c* as the developer regulating member is a non-magnetic plate member (part thereof can also be formed of a magnetic material) disposed below the developing roller 13*a*. The developing roller 13*a* rotates in the counterclockwise direction in FIG. 2, and the photosensitive drum 11 rotates in the clockwise direction in FIG. 2.

This configuration allows the rotation direction of the developing roller 13*a* to be set to a forward direction with respect to the photosensitive drum 11 at the developing gap even if the photosensitive drum 11 is disposed below the intermediate transfer belt 17 in order to achieve shortening of the conveying path for the recording medium P and horizontal downsizing of the apparatus body 1 of the image forming apparatus. Therefore, the developing time at the developing gap may be sufficiently ensured and the developing capability may be enhanced as compared with a case where the doctor blade 13*c* is disposed above the developing roller 13*a* and the rotation direction of the developing roller 13*a* with respect to the photosensitive drum 11 thereby becomes the opposite direction.

The two conveying screws 13*b*1 and 13*b*2 (conveying members) stir and mix the developer G while circulating the developer G stored in the developing device 13 along the longitudinal direction (which is orthogonal to the plane of paper in FIG. 2).

The first conveying screw 13*b*1 as the first conveying member is arranged at a position opposite to the developing roller 13*a*. The first conveying screw 13*b*1 horizontally conveys the developer G along the longitudinal direction (the rotation axis direction) (to the left, as shown by an arrowed dashed line in FIG. 3(B)), and supplies the developer G onto the developing roller 13*a* at the position of the developer-scoop-up magnetic pole H6 (sixth magnetic pole) (the supply to the direction of white arrows in FIG. 3(B)). The first conveying screw 13*b*1 rotates in the counterclockwise direction in FIG. 2.

The second conveying screw 13*b*2 as the second conveying member is arranged at a position above the first conveying screw 13*b*1 and opposite to the developing roller 13*a*. The second conveying screw 13*b*2 horizontally conveys the developer G released from the developing roller 13*a* (the developer G forcibly released from the developing roller 13*a* by the developer releasing magnetic pole H5 after the developing process, and is released to the direction of white arrows in FIG. 3(A)) along the longitudinal direction (to the right, as shown by an arrowed broken line in FIG. 3(A)). In the present embodiment, the rotation direction of the second conveying screw 13*b*2 is set to be the opposite direction to the rotation direction of the developing roller 13*a* (the clockwise direction in FIG. 2).

The second conveying screw 13*b*2 conveys the developer G circulated from the downstream side in the conveying path formed by the first conveying screw 13*b*1 through a first relay portion 13*f* to the upstream side in the conveying path formed by the first conveying screw 13*b*1 through a second relay portion 13*g* (in the arrow direction of dashed one-dotted line in FIG. 3(B)).

The two conveying screws 13*b*1 and 13*b*2 are arranged so that the rotational axes thereof become nearly horizontal, similarly to the developing roller 13*a* and the photosensitive drum 11. Both the two conveying screws 13*b*1 and 13*b*2 are formed in such a manner that a screw portion whose outer diameter is about 20 millimeters (screw pitch: about 40 millimeters; number of screw threads: one or two screw threads)

is helically wound around a shaft portion whose shaft diameter is about 6 to 10 millimeters. The number of revolutions of the two conveying screws 13*b*1 and 13*b*2 is set to about 600 to 900 rpm.

The conveying path formed by the first conveying screw 13*b*1 (the first conveying path) and the conveying path formed by the second conveying screw 13*b*2 (the second conveying path) are isolated by a wall portion.

Referring to FIGS. 3 and 4, the downstream side in the conveying path formed by the second conveying screw 13*b*2 (second conveying path) and the upstream side in the conveying path formed by the first conveying screw 13*b*1 (first conveying path) communicates with each other through the second relay portion 13*g*. The developer G having reached the downstream side in the second conveying path formed by the second conveying screw 13*b*2 drops by its own weight at the second relay portion 13*g*, to reach the upstream side in the first conveying path.

Referring to FIGS. 3 and 4, the downstream side in the conveying path formed by the first conveying screw 13*b*1 and the upstream side in the conveying path formed by the second conveying screw 13*b*2 communicate with each other through the first relay portion 13*f*. The developer G, which is not supplied onto the developing roller 13*a* through the first conveying path formed by the first conveying screw 13*b*1, remains and piles up near the first relay portion 13*f*, and is conveyed (supplied) to the upstream side in the second conveying path formed by the second conveying screw 13*b*2 through the first relay portion 13*f*.

In order to improve the conveying capability of the developer at the first relay portion 13*f* ("gravity-defying" transfer of the developer from the first conveying path to the second conveying path), a paddle-shaped unit or a screw unit formed in such a manner that a winding direction of a screw is opposite may also be provided at a position on the downstream side in the first conveying screw 13*b*1 (the position corresponding to the first relay portion 13*f*).

This configuration allows the two conveying screws 13*b*1 and 13*b*2 to form the circulation route through which the developer G is longitudinally circulated in the developing device 13. More specifically, when the developing device 13 is operated, the developer G inside the developing device 13 flows in the directions of the arrowed dashed lines in FIGS. 3 and 4. In this manner, the concentration deviation of the toner image formed on the photosensitive drum 11 may be reduced by separating the supplying route of the developer G to the developing roller 13*a* (the first conveying path formed by the first conveying screw 13*b*1) from the collecting route of the developer G released from the developing roller 13*a* (the second conveying path formed by the second conveying screw 13*b*2).

The magnetic sensor, which detects the toner concentration of the developer circulating in the developing device 13, is disposed in the conveying path formed by the second conveying screw 13*b*2 although it is not shown in the figure. New toner T is supplied to the developing device 13 from the toner container 28 through the toner supply port 13*e* (which is provided near the first relay portion 13*f*) based on the information for the toner concentration detected by the magnetic sensor.

Referring to FIGS. 3 and 4, the toner supply port 13*e* is provided at a position which is the upper side on the upstream side in the conveying path formed by the second conveying screw 13*b*2 and apart from the developing region (outside of the range along the longitudinal direction of the developing roller 13*a*). By providing the toner supply port 13*e* near the first relay portion 13*f*, the developer released from the developing roller 13*a* falls down from above the supply toner that has low specific gravity in the second conveying path, and the supply toner may be sufficiently dispersed and mixed into the developer over a relatively long time while moving toward the downstream side in the second conveying path.

In the present embodiment, the toner supply port 13*e* is provided in the developer conveying path formed by the second conveying screw 13*b*2, however, the position of the toner supply port 13*e* is not limited thereto. Therefore, for example, the toner supply port 13*e* may be provided at the upper portion on the upstream side in the first conveying path.

In addition, referring to FIG. 4, in the first conveying path, the level of the developer G is getting low from the upstream side toward the downstream side except for a portion near the first relay portion 13*f* in order to supply the developer to the developing roller 13*a* while conveying the developer along the longitudinal direction. On the other hand, in the second conveying path, the level of the developer G is getting high from the upstream side toward the downstream side because the developer released from the developing roller 13*a* is collected while conveying the developer along the longitudinal direction.

The developer G used in the present embodiment will be briefly explained below.

The toner T (which includes the toner in the developer G and the toner in the toner container 28) used in the present embodiment is polymerized toner. As a binder resin, styrene-base resin (single polymer or copolymer including styrene or styrene substitution) such as styrene-acrylonitrile-acrylic acid ester copolymer, and polyester resin, epoxy resin, or a compound of these may be used. As a method of manufacturing these polymerized toners (polymerization method), bulk polymerization, solution polymerization, emulsion polymerization, suspension polymerization, or the like may be used.

As external additives of the toner T, non-organic particles (e.g. those containing silica of 1.0% by weight and titanium oxide of 0.5% by weight) are preferably used. Furthermore, as a releasing agent, oxidized rice wax, low-molecular-weight polypropylene wax, carnauba wax, or the like may be used. In addition, a charge controlling agent may be contained in the releasing agent if necessary.

The toner T used in the present embodiment is formed so that its volume-average particle size is 5.8 micrometers and toner particles whose particle size is 5 micrometers or less are 60% to 80% by number.

The polymerized toner is used in the present embodiment, however, pulverized toner may also be used.

The carrier C in the developer G used in the present embodiment is formed so that its weight-average particle size is 20 to 60 micrometers. In the present embodiment, the carrier C whose weight-average particle size is 35 micrometers is used.

More specifically, the carrier C is formed so that methyl methacrylate resin (MMA) whose film thickness is 0.5 millimeter is coated on ferrite particles which become a core material and the above particle size of the carrier C is thereby obtained. As the carrier C, coating carrier with magnetite used as a core material may also be used.

By using such small sized carrier C, solid uniformity and halftone image quality of an output image may be improved.

Specific configuration and operation of the developing device 13 in the present embodiment will be explained below.

Referring to FIGS. 5 and 6, the separation member 13*d* (separating plate) for separating the first conveying path from the second conveying path is disposed at the position opposite to the developing roller 13*a* in the developing device 13 according to the present embodiment. In other words, there is the separation member 13*d*, which reduces the amount of the developer G re-carried on the developing roller 13*a* after being released from the developing roller 13*a*. The separation member 13*d* is disposed at the position opposite to the developing roller 13*a* and between the first conveying path and the second conveying path.

More specifically, the separation member 13*d* functions as a wall portion for separating the first conveying path from the second conveying path and is formed so as to protrude toward the developing roller 13*a*. Moreover, the separation member 13*d* is formed integrally with a developing case (a case member indicated by hatching in FIG. 2). The separation member 13*d* is formed so that a gap between its opposed surface opposite to the developing roller 13*a* and the developing roller 13*a* becomes 2 millimeters or less (preferably 0.1 to 0.5 millimeter). In the present embodiment, the gap between the separation member 13*d* and the developing roller 13*a* is set to 0.3 millimeter.

Referring to FIG. 6, a magnetic field directed from the inner side of the second conveying path toward the developing roller 13*a* (toward the side of the first conveying path) is produced, caused by the influence of the sixth magnetic pole H6, in a boundary region between the second conveying path and the first conveying path. By disposing the separation member 13*d* at the position where the magnetic field is blocked, it is possible to prevent an inconvenience that the developer right after it is collected in the second conveying path is again carried on the developing roller 13*a*. Moreover, the separation member 13*d* is disposed so as to face the developing roller 13*a* in a non-contact manner, which allows reduction of the inconvenience that the surface of the developing roller 13*a* may be damaged.

Because the separation member 13*d* is formed of a non-magnetic material, an inconvenience that the carrier as the magnetic body is magnetically attracted to the separation member 13*d* to block a flow of the developer in the second conveying path or to promote a movement of the developer to the first conveying path may be reduced.

Referring to FIG. 5, in the present embodiment, the second conveying screw 13*b*2 (second conveying member) is disposed so that when it is viewed as a cross section orthogonal to the rotational central axis of the developing roller 13*a* (FIG. 5), the position of the rotational central axis of the second conveying screw 13*b*2 is located below a virtual horizontal line passing the upper edge of the developing roller 13*a* and above a virtual horizontal line passing the lower edge of the developing roller 13*a*. More specifically, the position of the rotational central axis of the second conveying screw 13*b*2 (or a virtual horizontal line S2 passing the position) is provided within a range indicated by a double-pointed arrow M1.

By configuring the present embodiment in this manner, not only a magnetic force (outward magnetic force indicated by a dashed one-dotted line in FIG. 6) works in a direction in which the developer G is strongly released from the developing roller 13*a*; but also a resultant force of a centrifugal force due to rotation of the developing roller 13*a*, a pressure pushed by the developer at the downstream side, and of a gravity or the like act on the developer G carried on the developing roller 13*a* after the developing process, at the position of the developer-releasing magnetic pole H5. With this feature, the developer G carried on the developing roller 13*a* after the developing process is effectively released from the developing roller 13*a* without release failure of the developer from the developing roller 13*a* at the position of the separation member 13*d*, and the released developer G is smoothly collected to the second conveying path. Therefore, the developer G released from the developing roller 13*a* after the developing process in the second conveying path is hard to be re-carried on the developing roller 13*a* right after the release, and thus the inconvenience that uneven image density (concentration deviation) may occur on an output image is reliably reduced.

Referring to FIG. 5, in the present embodiment, a peak magnetic force of the first magnetic pole H1 is set to about 110 mT, a peak magnetic force of the second magnetic pole H2: about 70 mT, a peak magnetic force of the third magnetic pole H3: about 78 mT, a peak magnetic force of the fourth magnetic pole H4: about 45 mT, and a peak magnetic force of the sixth magnetic pole H6: about 65 mT.

The position of the developer-releasing magnetic pole H5 (fifth magnetic pole) is variable by adjusting the positions (half-value center angle) and the magnitudes (peak magnetic forces) of the fourth magnetic pole H4 and the sixth magnetic pole H6. However, in order to reliably prevent the developer from being carried together with a rotation of the developing roller 13*a* (release failure) at the position of the developer-releasing magnetic pole H5, the peak magnetic forces of the fourth magnetic pole H4 and the sixth magnetic pole H6 are preferably set to sufficiently large values which are equivalent to the above-mentioned magnitudes.

Furthermore, referring to FIG. 5, in the present embodiment, the separation member 13*d* is located at the position opposite to the developing roller 13*a*, while the opposed member 13*k* (release assist plate) facing the fourth magnetic pole H4 (which is a magnetic pole, of the two magnetic poles H4 and H6 forming the developer-releasing magnetic pole H5, formed at the upstream side of the developing roller 13*a* in its rotation direction) is disposed at the position on the upstream side (on the upstream side of the developing roller 13*a* in the rotation direction).

More specifically, the opposed member 13*k* functions as a wall portion for separating the position of the fourth magnetic pole H4 from the second conveying path in the developing roller 13*a*. Moreover, the opposed member 13*k* is formed integrally with the developing case (the case member indicated by hatching in FIG. 2).

Referring to FIG. 6, a magnetic field directed toward the upstream side of the developing roller 13*a* is produced caused by the influence of the fourth magnetic pole H4 (developer releasing pre-magnetic pole) at the upstream side of the developer-releasing magnetic pole H5 (the repulsive magnetic field acting on a direction away from the developing roller 13*a* in FIG. 6). By disposing the opposed member 13*k* at the position that blocks the magnetic field, it is possible to prevent the inconvenience that the developer released from the developing roller 13*a* at the position of the developer-releasing magnetic pole H5 is again carried (re-carried) on the developing roller 13*a*.

More specifically, as illustrated in FIG. 7B, if the opposed member 13*k* is not disposed, part of the developer (which moves in the direction of white arrow) released from the developing roller 13*a* at the developer-releasing magnetic pole H5 moves (moves in the direction of black arrow) toward the upstream side of the developing roller 13*a* caused by the magnetic field directed toward the upstream side of the developing roller 13*a* due to the influence of the fourth magnetic pole H4 (developer releasing pre-magnetic pole), and the part of the developer is thereby re-carried on the developing roller 13*a*. Once such a phenomenon occurs, the load of the developing roller 13*a* at the position where the developer is re-carried becomes heavy, or the re-carried developer may not be fully released from the developing roller 13*a* at the position of the developer-releasing magnetic pole H5, which causes the developer to enter into (or remain in) a gap between the separation member 13*d* and the developing roller 13*a*, and rotational torque of the developing roller 13*a* is thereby increased.

Meanwhile, in the present invention, as illustrated in FIG. 7A, because the opposed member 13*k* is disposed at the position facing the fourth magnetic pole H4 (developer releasing pre-magnetic pole), the magnetic field directed toward the upstream side of the developing roller 13*a* due to the influence of the fourth magnetic pole H4 is blocked, and it is thereby possible to reduce the inconvenience that the developer released from the developing roller 13*a* at the position of the developer-releasing magnetic pole H5 moves toward the upstream side of the developing roller 13*a* to be re-carried on the developing roller 13*a*. That is, the developer released from the developing roller 13*a* at the position of the developer-releasing magnetic pole H5 smoothly moves in the direction of white arrow in FIG. 7A.

Because the opposed member 13*k* is formed of a non-magnetic material, the inconvenience that the carrier as the magnetic body is magnetically attracted to the opposed member 13*k* to block a flow of the developer on the developing roller 13*a* or to block a movement of the developer to the second conveying path is reduced.

The inventors of this application conducted experiments. As a result, it is ascertained that the developing device 13 (illustrated in FIG. 7A) according to the present embodiment may reduce the rotational torque of the developing roller 13*a* by about 15% as compared with the developing device (illustrated in FIG. 7B) having no opposed member 13*k*.

Here, referring to FIG. 6 or the like, in the present embodiment, the opposed member 13*k* is formed so that an opposed surface 13*k*1 opposite to the developing roller 13*a* becomes nearly parallel to a virtual tangent line S3 that passes a closest point Q on the developing roller 13*a* to the opposed member 13*k* when the opposed member 13*k* is viewed as the cross section orthogonal to the rotational central axis of the developing roller 13*a*.

By configuring the present embodiment in this manner, the developer carried on the developing roller 13*a* is smoothly conveyed toward the position of the developer-releasing magnetic pole H5 without causing the developer carried on the developing roller 13*a* to stagnate at the position of the opposed member 13*k*.

Referring to FIG. 6 or the like, in the present embodiment, the opposed member 13*k* is formed so that a gap CG between the opposed surface 13*k*1 and the closest point Q on the developing roller 13*a* becomes equivalent to a gap (doctor gap) between the doctor blade 13*c* and the developing roller 13*a*. Specifically, in the present embodiment, the gap CG between the opposed member 13*k* and the developing roller 13*a* is set to about 0.5 millimeter.

With this configuration, a height (height of toner chains) of the developer carried on the developing roller 13*a* may be made equivalent to a height (height of toner chains) of the developer (which passes through the position of the doctor blade 13*c*) carried on the developing roller 13*a* after the amount of developer is regulated at the position of the opposed member 13*k*. Therefore, the opposed member 13*k* may reduce an inconvenience that adds stress to the developer carried on the developing roller 13*a*.

Referring to FIG. 6 or the like, in the present embodiment, the opposed member 13*k* is bent at a right angle so that a front end portion (surrounded by a solid circle in FIG. 6) thereof located at the downstream side of the developing roller 13*a* in the rotation direction is extended toward the inside of the second conveying path.

With this configuration, it is possible to reliably block the magnetic field directed toward the upstream side of the developing roller 13*a* due to the influence of the fourth magnetic pole H4, and it is also possible to suppress an inconvenience that the developer released from the developing roller 13*a* moves around to the back side (surface of the opposite side of the opposed surface 13*k*1) of the opposed member 13*k* caused by the magnetic field.

Referring to FIG. 5, FIG. 6, or the like, in the present embodiment, the front end portion (surrounded by a solid circle in FIG. 6) of the opposed member 13*k* located at the downstream side of the developing roller 13*a* in the rotation direction is extended below a virtual horizontal line S1 passing the rotational central axis of the developing roller 13*a*.

With this configuration, the magnetic field directed toward the upstream side of the developing roller 13*a* due to the influence of the fourth magnetic pole H4 can be reliably blocked.

Here, referring to FIG. 5, in the present embodiment, the first conveying screw 13*b*1 is provided so that the position of the rotational central axis of the first conveying screw 13*b*1 is located at a position (within a range M2 in FIG. 5) between a virtual vertical line passing the rotational central axis of the second conveying screw 13*b*2 and a virtual vertical line passing the rotational central axis of the developing roller 13*a* when it is viewed as the cross section orthogonal to the rotational central axis of the developing roller 13*a*.

This enables the first conveying screw 13*b*1 to be close to the developer-scoop-up magnetic pole H6 of the developing roller 13*a* and allows enhancement of supply performance of the developer G to the developing roller 13*a* by the first conveying screw 13*b*1.

As explained above, in the present embodiment, when the two conveying screws 13*b*1 and 13*b*2 (conveying members) that form the circulation route through which the developer G is conveyed along the longitudinal direction are arranged so as to face the developing roller 13*a* (developer carrier) and when the doctor blade 13*c* (developer regulating member) is disposed below the developing roller 13*a*, the separation member 13*d* is disposed opposite to the developing roller 13*a*, thereby optimizing the position of the developer-releasing magnetic pole H5 and the position of the second conveying path, and the opposed member 13*k* is disposed so as to face the fourth magnetic pole H4 at the upstream side of the two magnetic poles H4 and H6 that form the developer-releasing magnetic pole H5. Therefore, it is possible to reliably reduce the inconvenience that the developer G released from the developing roller 13*a* after the developing process in the second conveying path is again carried on the developing roller 13*a* while reducing an increase in rotational torque of the developing roller 13*a*.

In the present embodiment, the opposed member 13*k* and the separation member 13*d* are formed integrally with the developing case, however, the opposed member and the separation member may be formed of different members from the developing case. More specifically, a plate-shaped opposed member may also be hung from the developing case so as to face the fourth magnetic pole H4 of the developing roller 13*a*. In addition, a plate-shaped separation member may be adhered to the wall portion for separating the first conveying path from the second conveying path in the developing case. This configuration is useful for a case where although component precision of the developing case cannot be made so much high, the gap CG between the opposed member and the developing roller 13*a* or the gap between the separation member and the developing roller 13*a* is desired to be set highly precisely.

In the present embodiment, the toner T is supplied from the toner container 28 to the developing device 13, however, the developer G (the toner T and the carrier C) may also be supplied from the toner container (developer container) to the developing device 13. This case requires a unit for appropriately eliminating an excessive developer from the developing device 13. Even in this case, the same effect as that of the present embodiment may be obtained.

Also, in the present embodiment, the present invention is applied to the image forming apparatus configured to form the developing device 13 as a single unit that is detachably attached to the body of the image forming apparatus. However, the application of the present invention is not limited thereto. Accordingly, the present invention can be applied also to an image forming apparatus in which part of or the whole of the imaging units is formed as a process cartridge. In this case, maintenance workability of the imaging units may be improved.

Moreover, in the present embodiment, the present invention is applied to the developing device 13 provided with the two conveying screws as the conveying members, however, the present invention can be also applied to a developing device in which at least two conveying screws of three or more conveying screws are arranged so as to be opposite to the developing roller 13*a*. In the present embodiment, the number of magnetic poles H1 to H6 formed around the developing roller 13*a* is set to six, however, the number of magnetic poles formed around the developing roller 13*a* may also be set to five or less or seven or more.

Also, in these cases, by optimizing the position of the developer-releasing magnetic pole and the position of the second conveying path, the same effect as that of the present embodiment may be obtained.

The present invention is not limited to the present embodiment, and thus, it is obvious that the present embodiment may be changed if necessary in addition to the indication in the present embodiment within the scope of the technical idea of the present invention. The number, positions, and forms or the like of the components are not limited to the present embodiment, and thus, they may be set to those appropriate for implementation of the present invention.

Second Embodiment

Next, explanation will be made on a developing device, different from the developing device described above, provided with a release assist roller, as an opposed member, for assisting release of a developer from a developer carrier at a position of a developer-releasing magnetic pole by causing the magnetic force to act on the developer carried on the image carrier.

Figure 8:
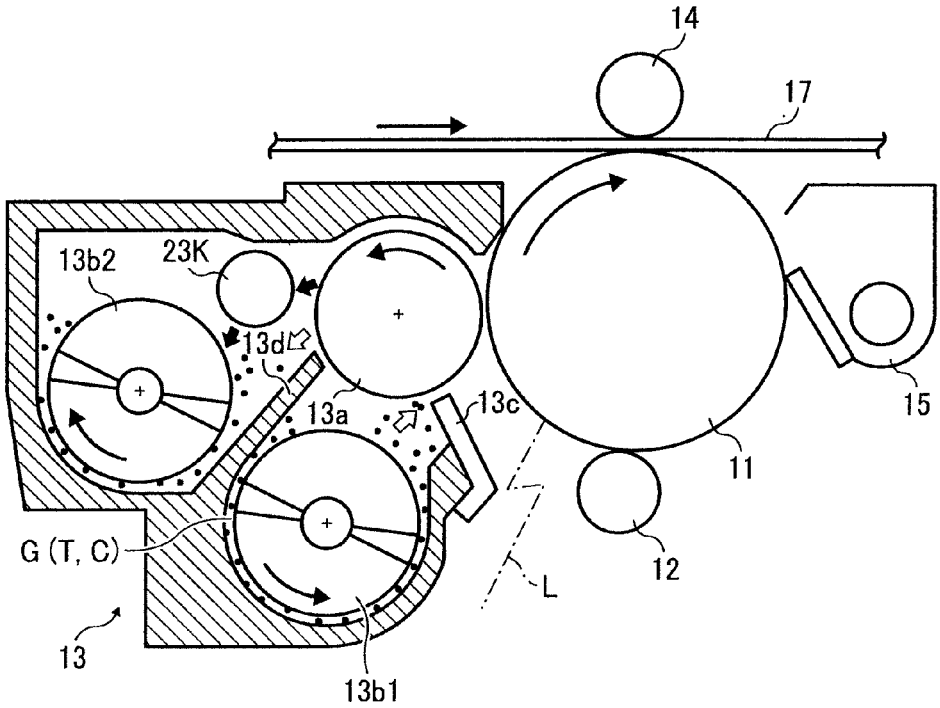
FIG. 8 is an explanatory diagram of a configuration example (2) of the imaging unit shown in FIG. 1.
Figure 9:
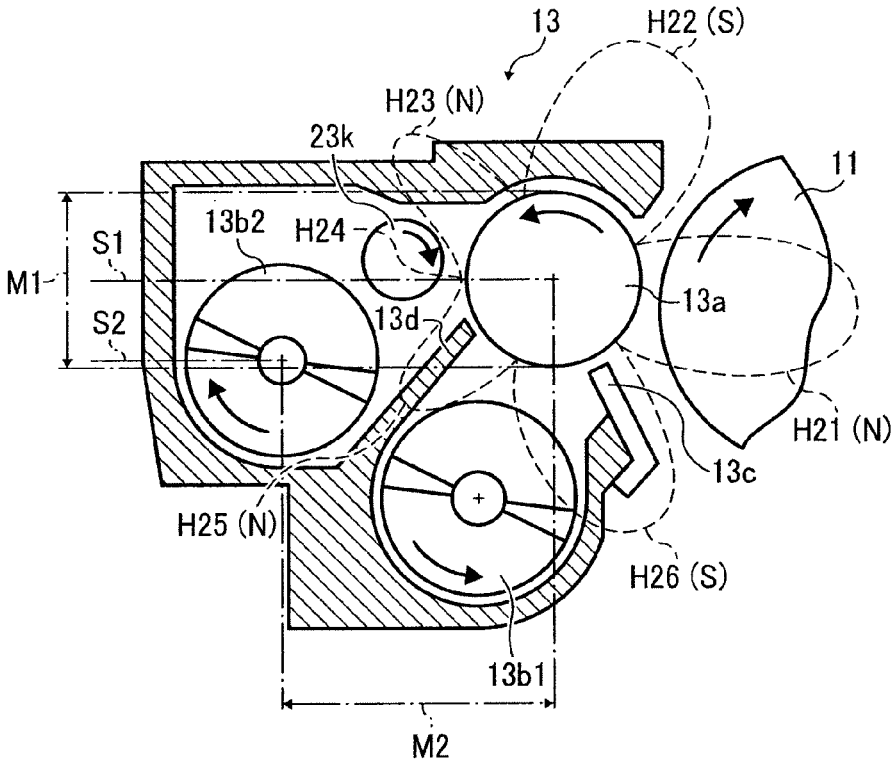
FIG. 9 is an explanatory diagram of a configuration example (2) of the developing device shown in FIG. 8.

FIG. 8 is an explanatory diagram of a configuration example (2) of the imaging unit shown in FIG. 1. FIG. 9 is an explanatory diagram of a configuration example (2) of the developing device shown in FIG. 8.

The configuration of the image forming apparatus provided with the developing device and the configuration of the circulation route i.e. of the conveying screw as the conveying member are the same as those illustrated in FIGS. 1, 3 and 4, thus omitting explanation thereof.

In the present embodiment, a release assist roller 23*k* is disposed in the developing device 13 of the imaging unit shown in FIG. 8.

More specifically, as illustrated in FIG. 9, there is provided the release assist roller 23*k*, at the position near the developer releasing magnetic pole H24 and opposite to the developing roller 13*a*, for assisting (promoting) release of the developer from the developing roller 13*a* at the position of the developer-releasing magnetic pole H24 by causing the magnetic force to act on the developer carried on the developing roller 13*a*. The configuration and the operation of the release assist roller 23*k* will be explained in detail later.

In addition, the configuration and the operations of magnetic poles of the developing device in FIG. 9 are the same as these of the first embodiment. Thus, explanation of the arrangement and operations of the magnetic poles and of a flow of the developer is omitted.

Specific configuration and operation of the developing device 13 according to the present embodiment will be explained below.

Figure 10:
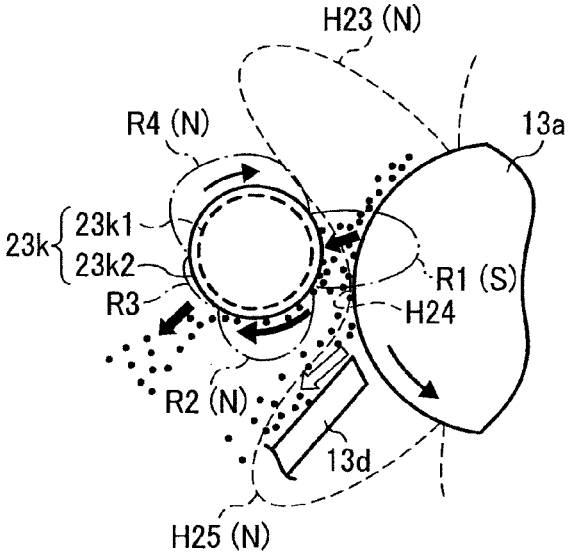
FIG. 10 is a schematic diagram of a flow of the developer near the developer-releasing magnetic pole when a release assist roller is disposed in the developing device shown in FIG. 9.

Referring to FIG. 9 and FIG. 10, in the developing device 13 according to the present embodiment, the separation member 13*d* is disposed opposite to the developing roller 13*a*, while the release assist roller 23*k* (developer releasing unit) is disposed at the position on the upstream side of the developing roller 13*a* in the rotation direction and opposite to the developing roller 13*a* near the third magnetic pole H23 (which is a magnetic pole, of the two magnetic poles H23 and H25 that form the developer-releasing magnetic pole H24, formed at the upstream side of the developing roller 13*a* in the rotation direction). The release assist roller 23*k* is used to assist (promote) release of the developer from the developing roller 13*a* at the position of the developer-releasing magnetic pole H24 by causing the magnetic force to act on the developer carried on the developing roller 13*a*.

More specifically, the release assist roller 23*k* is formed with a sleeve 23*k*2 that rotates in the clockwise direction in FIG. 9 (the opposite direction to the rotation direction of the developing roller 13*a*), a magnet 23*k*1 fixed inside the sleeve 23*k*2, and the like. The sleeve 23*k*2 is formed of a non-magnetic metal material such as aluminum. The magnet 23*k*1 forms a plurality of magnetic poles (four magnetic poles R1 to R4 in the present embodiment) around the sleeve 23*k*2.

FIG. 10 illustrates the magnetic poles R1 to R4 formed around the release assist roller 23*k* (sleeve 23*k*2) by the magnet 23*k*1. As shown in FIG. 10, these magnetic poles include a first magnetic pole R1 (developer-attracting magnetic pole) formed at the position opposite to the developing roller 13*a*, a second magnetic pole R2 (developer releasing pre-magnetic pole) that is formed at the downstream side of the first magnetic pole R1, a third magnetic pole R3 (developer-releasing magnetic pole) formed at the position between the second magnetic pole R2 and a fourth magnetic pole R4 and opposite to the second conveying screw 13*b*2, and the fourth magnetic pole R4 (post-developer releasing magnetic pole) formed at the upstream side of the first magnetic pole R1.

First, the first magnetic pole R1 (developer-attracting magnetic pole) acts on the developer (carrier) carried on the developing roller 13*a* opposite thereto, so that part of the developer carried on the developing roller 13*a* is released from the developing roller 13*a* and is attracted to the release assist roller 23*k* (or, a retention force of the developer on the developing roller 13*a* is weakened). The developer carried on the release assist roller 23*k* is conveyed to the position of the third magnetic pole R3 (developer-releasing magnetic pole) by the second magnetic pole R2. The repulsive magnetic field (which is a magnetic field acting on a direction away from the release assist roller 23*k*) acts on the carrier at the position of the developer-releasing magnetic pole R3, so that the developer G carried on the release assist roller 23*k* after the developing process is released from the release assist roller 23*k* (which indicates a flow of the developer in the direction of black arrow in FIG. 10). The developer G after being released drops in the second conveying path and is conveyed toward the downstream in the second conveying path by the second conveying screw 13$b$2. The developer not being attracted to the release assist roller 23$k$ and retained on the developing roller 13$a$ is successfully released from the developing roller 13$a$ at the position of the developer-releasing magnetic pole H24 of the developing roller 13$a$ after the retention force is weakened by the magnetic force of the first magnetic pole R1 (which indicates a flow of the developer in the direction of white arrow in FIG. 10).

Here, referring to FIG. 10, the four magnetic poles R1 to R4 are formed of three poles (magnetic poles with "(N)" or "(S)" added to the reference numerals in FIG. 10) magnetized by the magnet 23$k$1 of the release assist roller 23$k$. More specifically, among the four magnetic poles R1 to R4, only the third magnetic pole R3 (developer-releasing magnetic pole) is not directly formed by the pole magnetized by the magnet 23$k$1, but is formed in such a manner that it is sandwiched by the two magnetic poles (the second magnetic pole R2 and the fourth magnetic pole R4) being the same pole (north (N) pole in the present embodiment).

The first magnetic pole R1 (developer-attracting magnetic pole) of the release assist roller 23$k$ is formed so that the polarity thereof is different from the polarity of the two magnetic poles H23 and H25 on the developing roller 13$a$ that form the developer-releasing magnetic pole H24. More specifically, the polarity of the third magnetic pole H23 and the fifth magnetic pole H25 on the developing roller 13$a$ is the N pole, while the polarity of the first magnetic pole R1 (developer-attracting magnetic pole) is set to the S pole. This allows smooth release of the developer from the developing roller 13$a$ at the position of the developer-releasing magnetic pole H24.

Here, in the present embodiment, the release assist roller 23$k$ is set in such a manner that the outer diameter of the sleeve 23$k$2 is 10 millimeters, the outer diameter of the magnet 23$k$1 is 9 millimeters, and a gap with the developing roller 13$a$ is 2 millimeters.

The sleeve 23$k$2 of the release assist roller 23$k$ is made to rotate so that its linear velocity on its outer periphery becomes a linear velocity ratio of 0.5 to 1 to a linear velocity on the outer periphery of the developing roller 13$a$. More specifically, in the present embodiment, the sleeve 23$k$2 of the release assist roller 23$k$ is set so that the linear velocity on the outer periphery becomes 250 mm/sec.

With this configuration, the release of the developer from the developing roller 13$a$ is smoothly performed at the position of the developer-releasing magnetic pole H24. More specifically, the release failure of the developer from the developing roller 13$a$ at the position of the developer-releasing magnetic pole H24 is reduced, and the inconvenience that the developer released from the position of the developing roller 13$a$ after the developing process in the second conveying path is re-carried on the developing roller 13$a$ is hard to occur.

Referring to FIG. 9 and FIG. 10, the separation member 13$d$ for separating the first conveying path from the second conveying path is disposed at the position opposite to the developing roller 13$a$ in the developing device 13 according to the present embodiment. In other words, there is the separation member 13$d$, which reduces the amount of the developer G released from the developing roller 13$a$ and re-carried on the developing roller 13$a$, disposed at the position opposite to the developing roller 13$a$ and between the first conveying path and the second conveying path.

More specifically, the separation member 13$d$ functions as the wall portion that separates the first conveying path from the second conveying path, and is formed so as to protrude toward the developing roller 13$a$. Moreover, the separation member 13$d$ is formed integrally with the developing case (which is the case member indicated by hatching in FIG. 8). The separation member 13$d$ is formed so that a gap between its opposed surface opposite to the developing roller 13$a$ and the developing roller 13$a$ becomes 2 millimeters or less (preferably 0.1 to 0.5 millimeter). In the present embodiment, the gap between the separation member 13$d$ and the developing roller 13$a$ is set to 0.3 millimeter.

Produced in a boundary region between the second conveying path and the first conveying path is a magnetic field directed from the inner side of the second conveying path toward the developing roller 13$a$ (toward the side of the first conveying path) caused by the influence of the fifth magnetic pole H25. By disposing the separation member 13$d$ at the position where the magnetic field is blocked, it is possible to prevent the inconvenience that the developer right after it is collected in the second conveying path is again carried on the developing roller 13$a$. Moreover, the separation member 13$d$ is arranged so as to face the developing roller 13$a$ in a non-contact manner, which allows reduction of the inconvenience that the surface of the developing roller 13$a$ may be damaged.

Because the separation member 13$d$ is formed of a non-magnetic material, the inconvenience that the carrier as the magnetic body is magnetically attracted to the separation member 13$d$ to block a flow of the developer in the second conveying path or to promote a movement of the developer to the first conveying path may be reduced.

Referring to FIG. 9, in the present embodiment, the second conveying screw 13$b$2 (second conveying member) is arranged so that when it is viewed as a cross section orthogonal to the rotational central axis of the developing roller 13$a$ (FIG. 9), the position of the rotational central axis of the second conveying screw 13$b$2 is located below a virtual horizontal line passing the upper edge of the developing roller 13$a$ and above a virtual horizontal line passing the lower edge of the developing roller 13$a$. More specifically, the position of the rotational central axis of the second conveying screw 13$b$2 (or the virtual horizontal line S2 passing the position) is provided within the range indicated by the double-pointed arrow M1.

By configuring the present embodiment in this manner, a force with which the developer G is strongly released from the developing roller 13$a$ is acted on the developer G carried on the developing roller 13$a$ after the developing process by the release assist roller 23$k$ at the position on the upstream side of the developer-releasing magnetic pole H24, and a resultant force of a magnetic force that works in a direction in which the developer G is strongly released from the developing roller 13$a$, a centrifugal force due to rotation of the developing roller 13$a$, a pressure pushed by the developer at the downstream side, and of gravity acts on the developer G carried on the developing roller 13$a$ after the developing process at the position of the developer-releasing magnetic pole H24. With this feature, the developer G carried on the developing roller 13$a$ after the developing process is effectively released from the developing roller 13$a$ over a range from the position opposite to the release assist roller 23$k$ to the position opposite to the separation member 13$d$ without release failure of the developer from the developing roller 13$a$, and the released developer G is smoothly collected to the second conveying path. Therefore, the release failure of the developer G from the developing roller 13$a$ is hard to occur, and the developer G released from the developing roller 13$a$ after the developing process in the second conveying path right is hard to be re-carried on the developing roller 13$a$ right after the release, which allows reliable reduction of the inconvenience that uneven image density (concentration deviation) may occur on an output image.

Figure 11:
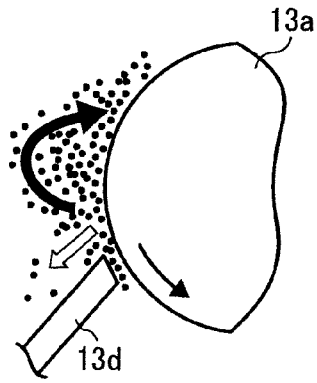
FIG. 11 is a schematic diagram of a flow of the developer near the developer-releasing magnetic pole when the release assist roller is not disposed in the developing device.

Meanwhile, as shown in FIG. 11, if the release assist roller 23*k* is not provided, part of the developer (which moves in the direction of white arrow) released from the developing roller 13*a* at the position of the developer-releasing magnetic pole H24 moves to the upstream side of the developing roller 13*a* (moves in the direction of bold black arrow) caused by the magnetic field directed toward the upstream side of the developing roller 13*a* due to the influence of the fourth magnetic pole H24 (developer releasing magnetic pole), and the part of the developer is thereby re-carried on the developing roller 13*a*. Once such a phenomenon occurs, the load of the developing roller 13*a* at the position where the developer is re-carried becomes heavy, or the re-carried developer may not be fully released from the developing roller 13*a* at the position of the developer-releasing magnetic pole H24, which causes the developer to enter into (or remain in) a gap between the separation member 13*d* and the developing roller 13*a*, and rotational torque of the developing roller 13*a* is thereby increased.

On the other hand, in the present embodiment, as illustrated in FIG. 10, because the release assist roller 23*k* is disposed at the position facing the third magnetic pole H23 (developer releasing pre-magnetic pole), it is possible to reduce the inconvenience that the developer released from the developing roller 13*a* at the position of the developer-releasing magnetic pole H24 moves toward the upstream side of the developing roller 13*a* to be re-carried on the developing roller 13*a* because the developer is attracted to the release assist roller 23*k*, so that the magnetic field directed toward the upstream side of the developing roller 13*a* due to the influence of the third magnetic pole H23 is overcome. That is, the developer released from the developing roller 13*a* at the position of the developer-releasing magnetic pole H24 smoothly moves in the direction of white arrow in FIG. 10.

Here, referring to FIG. 9, in the present embodiment, the first conveying screw 13*b*1 is provided so that the position of the rotational central axis of the first conveying screw 13*b*1 is located at a position (within a range M2 in FIG. 9) between a virtual vertical line passing the rotational central axis of the second conveying screw 13*b*2 and a virtual vertical line passing the rotational central axis of the developing roller 13*a* when it is viewed as the cross section orthogonal to the rotational central axis of the developing roller 13*a*.

This enables the first conveying screw 13*b*1 to be close to the developer-scoop-up magnetic pole H26 of the developing roller 13*a* and allows enhancement of supply performance of the developer G to the developing roller 13*a* by the first conveying screw 13*b*1.

As explained above, in the present embodiment, when the two conveying screws 13*b*1 and 13*b*2 (conveying members) that form the circulation route through which the developer G is conveyed along the longitudinal direction are arranged so as to face the developing roller 13*a* (developer carrier), and when the doctor blade 13*c* (developer regulating member) is disposed below the developing roller 13*a*, the separation member 13*d* is disposed opposite to the developing roller 13*a*, and the release assist roller 23*k* is disposed near the third magnetic pole H23 at the upstream side of the two magnetic poles H23 and H25 that form the developer-releasing magnetic pole H24. Therefore, the developer G is successfully released from the developing roller 13*a* at the position of the developer-releasing magnetic pole H24, and thus, it is hard to cause an inconvenience that the developer G released from the developing roller 13*a* after the developing process in the second conveying path is again carried on the developing roller 13*a*. Especially, even if the fluidity of the developer is decreased caused by degradation of the developer over time, the configuration according to the present embodiment allows the developer G to be successfully released from the developing roller 13*a* at the position of the developer-releasing magnetic pole H24, and thus, it is hard to cause the inconvenience that the developer G released from the developing roller 13*a* after the developing process in the second conveying path is again carried on the developing roller 13*a*.

In the present embodiment, the opposed member 13*k* and the separation member 13*d* are formed integrally with the developing case, however, the separation member and the developing case can be formed of separate members. More specifically, a plate-shaped separation member can be adhered to the wall portion for separating the first conveying path from the second conveying path in the developing case. This configuration is useful for a case where although component precision of the developing case cannot be made so much high, the gap between the separation member and the developing roller 13*a* is desired to be set highly precisely.

In the present embodiment, the toner T is supplied from the toner container 28 to the developing device 13, however, the developer G (the toner T and the carrier C) can also be supplied from the toner container (developer container) to the developing device 13. This case requires a unit for appropriately eliminating an excessive developer from the developing device 13. Even in this case, the same effect as that of the present embodiment can be obtained.

Also, in the present embodiment, the present invention is applied to the image forming apparatus configured to form the developing device 13 as a single unit that is detachably attached to the body of the image forming apparatus. However, the application of the present invention is not limited thereto. Accordingly, the present invention can be applied also to an image forming apparatus in which part of or the whole of the imaging units is formed as a process cartridge. In this case, maintenance workability of the imaging units can be improved.

Moreover, in the present embodiment, the present invention is applied to the developing device 13 provided with the two conveying screws as the conveying members, however, the present invention can be also applied to a developing device in which at least two conveying screws of three or more conveying screws are arranged so as to be opposite to the developing roller 13*a*. In the present embodiment, the number of magnetic poles H21 to H26 formed around the developing roller 13*a* is set to six, however, the number of magnetic poles formed around the developing roller 13*a* can also be set to five or less or 7 or more. Furthermore, in the present embodiment, the number of magnetic poles R1 to R4 formed around the release assist roller 23*k* is four, however, the number of magnetic poles formed around the release assist roller 23*k* may be set to three or less or five or more.

Also, in these cases, by disposing the release assist roller 23*k* near the developer-releasing magnetic pole, the same effect as that of the present embodiment can be obtained.

According to the present invention, when at least two conveying members of the conveying members that form the circulation route through which the developer is conveyed along the longitudinal direction are arranged so as to be opposite to the developer carrier, and when the developer regulating member is disposed below the developer carrier, the separation member is disposed opposite to the developer carrier, and the opposed member facing the upstream-side magnetic pole of the two magnetic poles that form the developer-releasing magnetic pole is also provided. Therefore, it is possible to provide the developing device, the process cartridge, and the image forming apparatus capable of suppressing that the developer released from the developer carrier after the developing process in the second conveying path is again carried on the developer carrier while reducing an increase in rotational torque of the developer carrier.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device that stores therein a developer containing carrier and toner and develops a latent image formed on an image carrier, the developing device comprising:

a developer carrier that is disposed opposite to the image carrier and forms a plurality of magnetic poles around the developer carrier, one of the plurality of magnet poles being a developer-releasing magnet pole for releasing the developer carried on the developer carrier, the developer-releasing magnet pole being sandwiched by two magnet poles of said plurality of magnet poles, said two magnet poles having the same polarity as each other;

a developer regulating member that is disposed below the developer carrier so as to oppose thereto and regulates an amount of the developer carried on the developer carrier; and a plurality of conveying members that forms a circulation route through which the developer stored in the developing device is conveyed along a longitudinal direction, wherein the plurality of conveying members includes a first conveying member that is opposite to the developer carrier and supplies the developer to the developer carrier while conveying the developer along the longitudinal direction, and a second conveying member that is disposed above the first conveying member so as to face the developer carrier, and conveys the developer released from the developer carrier along the longitudinal direction, the developing device further comprises:

a separation member that is disposed in a position opposite to the developer carrier, and separates a first conveying path formed by the first conveying member from a second conveying path formed by the second conveying member; and an opposed member facing a magnetic pole, of the two magnetic poles, at an upstream side of the developer carrier in its rotation direction, the opposed member disposed upstream of the developer carrier in the rotation direction relative to the position of the separation member, the opposed member extending away from a position which supports the opposed member in a direction which is downstream of the position which supports the opposed member, relative to the rotation direction.

2. The developing device according to claim 1, wherein an opposed surface of the opposed member which is opposite to the developer carrier becomes parallel to a virtual tangent line passing a closest point on the developer carrier to the opposed member when the opposed member is viewed as a cross section orthogonal to a rotational central axis of the developer carrier.

3. The developing device according to claim 2, wherein a gap between the opposed surface and the closest point on the developer carrier is equivalent to a gap between the developer regulating member and the developer carrier.

4. The developing device according to claim 3, wherein a volume-average particle size of the toner contained in the developer is 5.8 microns.

5. The developing device according to claim 1, wherein an edge portion of the opposed member extends toward an inner side of the second conveying path.

6. The developing device according to claim 1, wherein an edge portion of the opposed member extends below a virtual horizontal line passing a rotational central axis of the developer carrier when the opposed member is viewed as a cross section orthogonal to the rotational central axis of the developer carrier.

7. The developing device according to claim 1, wherein the opposed member is formed integrally with a developing case.

8. The developing device according to claim 1, wherein the opposed member is a release assist roller for assisting release of the developer from the developer carrier at a position of the developer-releasing magnetic pole by causing a magnetic force to act on the developer carried on the developer carrier.

9. The developing device according to claim 1, wherein the carrier has a weight-average particle size from 20 to 60 micrometers.

10. A process cartridge for use with an apparatus body of an image forming apparatus, comprising:

a developing device according to claim 1; and the image carrier.

11. An image forming apparatus comprising:

a developing device according to claim 1; and the image carrier.

12. The developing device according to claim 1, wherein the opposed member comprises a non-magnet material.

13. The developing device according to claim 1, wherein a rotational axis of the second conveying member at a center of the second conveying member is below an upper edge of the developer carrier and above a lower edge of the developer carrier.

14. The developing device according to claim 1, wherein a rotational axis of the first conveying member is located between a rotational axis of the second conveying member and a rotational axis of the developer carrier.

15. A developing device that stores therein a developer containing carrier and toner and develops a latent image formed on an image carrier, the developing device comprising:

a developer carrier that is disposed opposite to the image carrier and forms a plurality of magnetic poles around the developer carrier;

a developer regulating member that is disposed below the developer carrier so as to oppose thereto and regulates an amount of the developer carried on the developer carrier; and a plurality of conveying members that forms a circulation route through which the developer stored in the developing device is conveyed along a longitudinal direction, wherein the plurality of conveying members includes a first conveying member that is opposite to the developer carrier and supplies the developer to the developer carrier while conveying the developer along the longitudinal direction, and a second conveying member that is disposed above the first conveying member so as to face the developer carrier, and conveys the developer released from the developer carrier along the longitudinal direction, the developing device further comprises a separation member that is disposed in a position opposite to the developer carrier, and separates a first conveying path formed by the first conveying member from a second conveying path formed by the second conveying member, wherein the developer carrier is formed in such a manner that a developer-releasing magnetic pole for releasing the developer carried on the developer carrier, among the plurality of magnetic poles, is sandwiched by two magnetic poles having the same polarity, and an opposed member facing a magnetic pole, of the two magnetic poles, formed at an upstream side of the developer carrier in its rotation direction is disposed at the upstream side of the developer carrier in the rotation direction while the separation member is located opposite to the developer carrier, wherein the opposed member is a release assist roller for assisting release of the developer from the developer carrier at a position of the developer-releasing magnetic pole by causing a magnetic force to act on the developer carried on the developer carrier, wherein the release assist roller includes a sleeve rotating in a direction opposite to the rotation direction of the developer carrier, and a magnet fixed to an inner side of the sleeve and forming a plurality of magnetic poles around the sleeve, wherein the magnet of the release assist roller forms a first magnetic pole, as one of the plurality of magnetic poles, having a polarity different from that of the two magnetic poles of the developer carrier at a position opposite to the developer carrier.

16. The developing device according to claim 15, wherein the magnet of the release assist roller forms a developer-releasing magnetic pole for releasing the developer carried on the release assist roller, as a magnetic pole different from the first magnetic pole of the plurality of magnetic poles, in such a manner that the developer-releasing magnetic pole is sandwiched by two magnetic poles having the same polarity, at a position opposite to the second conveying member.

17. The developing device according to claim 15, wherein the sleeve of the release assist roller is made to rotate so that a linear velocity on its outer periphery becomes a linear velocity ratio of 0.5 to 1 to a linear velocity on an outer periphery of the developer carrier.

* * * * *